United States Patent [19]

Sasao

[11] Patent Number: 4,704,597

[45] Date of Patent: Nov. 3, 1987

[54] ELEVATOR TRAVEL DETECTING APPARATUS

[75] Inventor: Isao Sasao, Inazawa, Japan

[73] Assignee: Mitsubishi Denki Kabushiki Kaisha, Tokyo, Japan

[21] Appl. No.: 461,310

[22] Filed: Jan. 26, 1983

[30] Foreign Application Priority Data

Mar. 29, 1982 [JP] Japan ..... 57-50519

[51] Int. Cl.[4] ..... B66B 3/00

[52] U.S. Cl. ..... 187/134

[58] Field of Search ..... 340/21, 19 R; 187/29 R; 307/247 A, 242, 542; 328/71, 72, 55; 318/329, 311, 313, 314, 326, 327

[56] References Cited

U.S. PATENT DOCUMENTS 4,102,437 7/1978 Mandel ..... 340/21 X
4,218,671 8/1980 Lewis ..... 340/21
4,232,257 11/1980 Harshberger ..... 318/314
4,346,788 8/1982 Shung ..... 340/21 X
4,426,714 1/1984 Ashida ..... 328/72 X

*Primary Examiner*—Ulysses Weldon
*Attorney, Agent, or Firm*—Sughrue, Mion, Zinn, Macpeak and Seas

[57] ABSTRACT

An elevator cage travel detector includes an apertured disc 8 whose rotational movement is sensed by a photo encoding pulse generator 9 which produces two phase displaced outputs 10*b*, 11*b*. To prevent motion detection errors due to false generations of one of the pulse outputs when the cage is at rest, due to vibrations or the like, each pulse train is fed to both its own flip-flop 14C, 14D and to a leading and trailing edge detector 14A, 14B whose output enables a flip-flop for the other pulse train. The further processing of the two pulse trains is thus mutually dependent upon the continuing generation of both of them.

5 Claims, 12 Drawing Figures

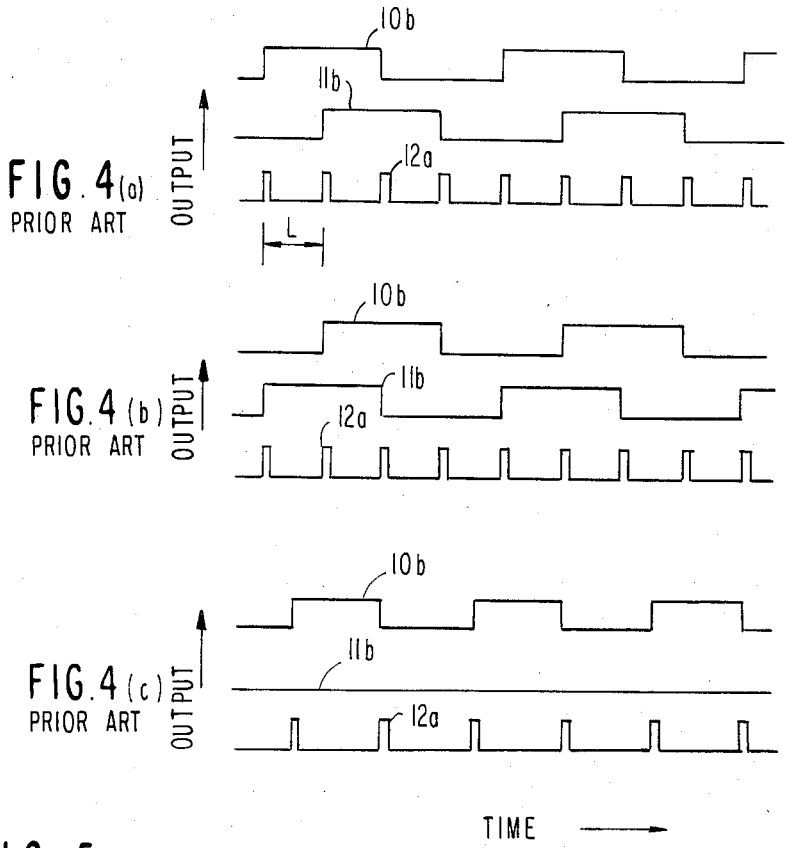
FIG. 5
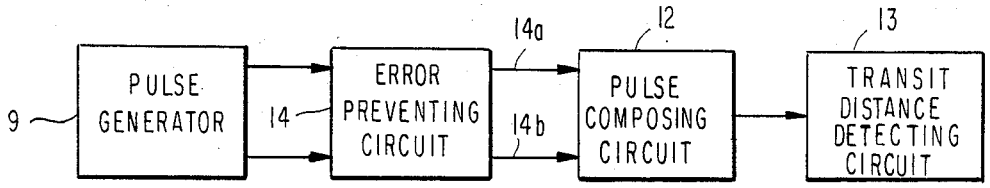
FIG. 6
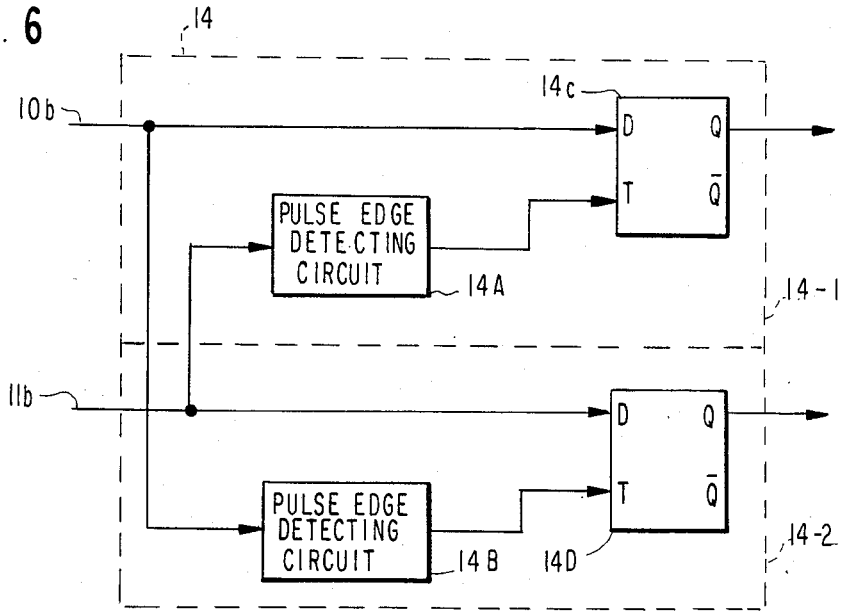

ELEVATOR TRAVEL DETECTING APPARATUS

BACKGROUND OF THE INVENTION

This invention relates in general to a travel detecting apparatus for an elevator, and more particularly to a cage position detector for a digital elevator control.

Digital control systems have recently been applied to elevators because of improvements in electronic and integrated circuit technology. For detecting the transit distance and/or direction of travel of the elevator cage, the conventional mechanical floor selector has also been replaced by a digital type of cage position detector which responds to at least two pulses differing from each other in phase.

DESCRIPTION OF PRIOR ART

One embodiment of a conventional cage position detector is illustrated in FIGS. 1 through 4, as disclosed in laid open Japanese Utility Model Publication No. 52-46465. Referring to FIG. 1, the arrangement comprises a motor 1 and a traction sheave 2 driven thereby, and an elevator cage 4 connected to a counterweight 5 through a main cable 3 which is wound on the traction sheave. An auxiliary cable 6 is wound on a tension sheave 7 and a disc 8, and both of its ends are connected to the cage 4. The sheave 7 is disposed at the lower part of a hoistway or elevator shaft (not shown), and provides the auxiliary cable with downward tension.

The disc 8 is disposed in a machinery room (not shown) at the upper part of the hoistway, and has a plurality of small apertures 8a in its peripheral portion at regular intervals, as shown in FIG. 2. A pulse generator 9 comprises a first detector 10 and a second detector 11 mounted at the peripheral portion of the disc 8. The detectors 10, 11, known as a phototype rotary encoder and described in Japanese technical magazine (DENSHI KAGAKU) Vol. 30, No. 14, pages 46–47, generate pulses 10*b* and 11*b*, respectively, each time they detect a light beam 10*a*, 11*a* passing through the apertures 8*a*. As may be seen from FIG. 2, the circumferential spacing between the detector light beams is slightly less than that between any two adjacent disc apertures 8*a*.

The pulse signals 10*b*, 11*b* from the generator 9 are supplied to a pulse composing circuit 12, and the output signal 12*a* from the circuit 12 is fed to a transit distance detecting circuit or counter 13, shown in FIG. 3.

Upon the ascent or descent of the elevator cage 4, the disc 8 is rotated through the movement of hte auxiliary cable 6. The first detector 10 in the pulse generator 9 generates a high level (H) pulse 10*b* each time its light beam 10*a* passes through a small aperture 8*a*, and a low level signal (L) when the light beam 10*a* is interrupted by the disc 8. The second detector 11 in the pulse generator 9 generates the pulses 11*b* in the same manner.

Because the first and second detectors 10, 11 are slightly shifted in their circumferential positions, the generated pulses 10*b*, 11*b* are shifted or displaced in phase relative to each other, as shown in FIGS. 4(*a*) and 4(*b*). More specifically, when the disc 8 is rotated in the direction of arrow A in FIG. 2 the pulse 11*b* is preceded by the pulse 10*b* as shown in FIG. 4(*a*), while when the disc 8 is rotated in the direction of arrow B the pulse 10*b* is preceded by the pulse 11*b* as shown in FIG. 4(*b*).

The pulse composing circuit 12 generates movement pulses 12*a* at both the leading and trailing edges of each of the pulses 10*b*, 11*b*. The transit distance detecting circuit 13 counts the number of movement pulses 12*a* to detect the distance that the elevator cage 4 has travelled. The direction of the elevator cage movement, up or down, can also easily be determined from the relative phase relationship between the pulses 10*b*, 11*b*, as will be readily apparent to a person of ordinary skill in the art.

Theoretically, when the disc 8 is stopped no movement pulses 12*a* are generated because the signal levels of the pulses 10*b*, 11*b* remain constant, i.e. no transitions should occur from low to high, or vice versa. In actual practice, however, it has been found that some movement pulses 12*a* are still generated on occasion, even when the disc 8 is stopped. It has been determined that such erroneous pulse generation or malfunctioning occurs in dependence upon the relative position between the first or second detectors 10, 11 and the apertures 8*a*. In the positions shown in FIG. 2, for example, when the disc 8 is stopped at a critical point for the operations of the first detector 10 (just before the pulse 10*b* is fully generated), the first detector may erroneously generate pulses 10*b* (FIG. 4(*c*)) due to vibrations of the disc 8 or fluctuations of the power source for the pulse generator 9, while the output of the second detector 11 remains constant. This results in misdetection in that the transit distance detecting circuit 13 counts the erroneous movement pulses 12*a* even though the elevator cage 4 is stopped.

SUMMARY OF THE INVENTION

It is an object of the present invention to provide an elevator travel detecting apparatus which eliminates the aforementioned disadvantage.

In accordance with this and other objects of the invention, an elevator travel detecting apparatus is provided including a pulse generator which generates first and second phase displaced pulse signals, an error preventing circuit which receives the first and second pulse signals and outputs them only when they have both been received, a pulse composing circuit which receives the output signals from the error preventing circuit and generates movement pulses, and a transmit distance detecting circuit which counts the number of movement pulses to detect the transmit distance of the elevator cage.

BRIEF DESCRIPTION OF THE DRAWINGS

FIG. 5 is a block diagram which shows a signal processing circuit in accordance with an embodiment of this invention, FIG. 6 is a block diagram of the misoperation preventing circuit shown in FIG. 5, FIGS. 7(*a*) and 7(*b*) are signal waveforms for explaining the operation of this invention, FIG. 8(*a*) is a block diagram of the pulse edge detecting circuits of FIG. 6, and FIG. 8(*b*) shows signal waveforms in the pulse edge detecting circuit shown in FIG. 8(*a*).

DETAILED DESCRIPTION OF THE PREFERRED EMBODIMENT

Figure 3:
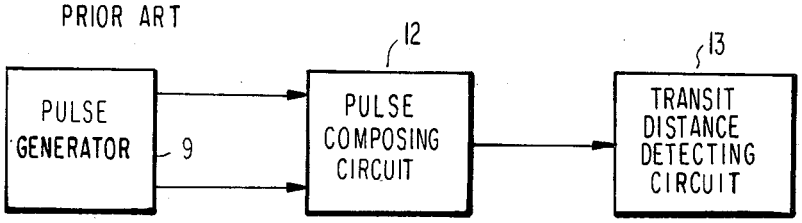
FIG. 3 PRIOR ART
FIG. 3 is a block diagram which shows a conventional signal processing circuit for the cage position detector shown in FIG. 1, FIGS. 4(*a*), 4(*b*) and 4(*c*) are signal waveforms which show output signals derived from the pulse generator and the pulse composing circuit shown in FIG. 3.

A preferred embodiment of the invention will be described with reference to FIGS. 5 through 7. In FIG. 5, reference numeral 14 designates an error preventing circuit inserted between the pulse generator 9 and the pulse composing circuit 12 of FIG. 3.

FIG. 6 shows one embodiment of the error preventing circuit 14, which comprises a first control circuit 14-1 and a second control circuit 14-2. Reference numeral 14A designates a pulse edge detecting circuit which generates a pulse 14A*a* (FIG. 7(*a*)) at the leading and trailing edges of the pulse 11*b*, and 14B designates a pulse edge detecting circuit which generates a pulse 14B*a* at the leading and trailing edges of the pulse 10*b*. Reference numerals 14C and 14D designate well-known D-T type flip-flop circuits. The flip-flop circuit 14C receives the pulse signal 10*b* and the pulse 14A*a* at its input terminals D and T, respectively, and generates a pulse signal 14*a* at its output terminal Q. Similarly, the flip-flop circuit 14D receives the pulse signal 11*b* and the pulse 14B*a* at its input terminals D and T, and generates a pulse signal 14*b* at its output terminal Q.

Figure 1:
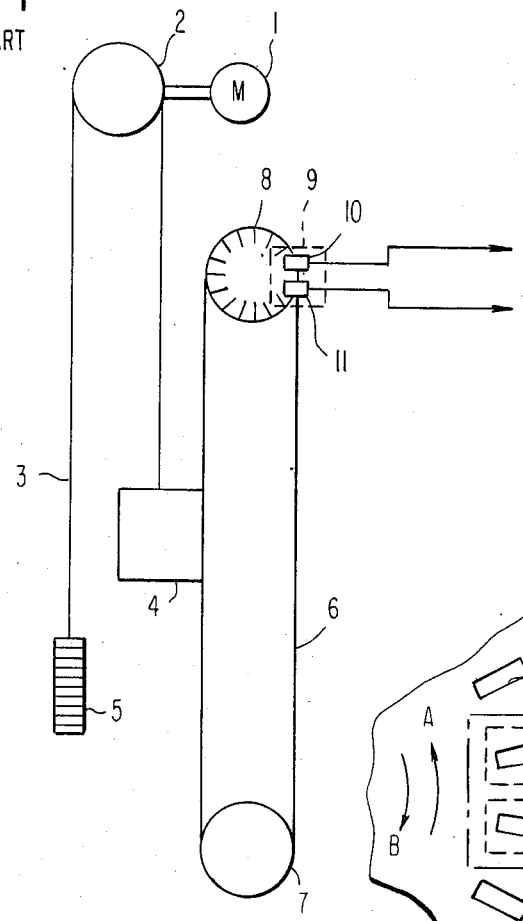
FIG. 1 PRIOR ART
FIG. 1 is a schematic illustration of an elevator system having a cage position detector to which this invention is applied.
Figure 2:
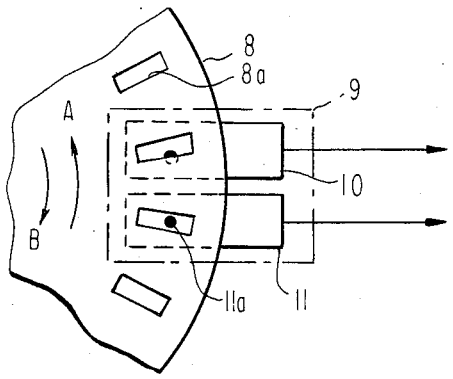
FIG. 2 PRIOR ART
FIG. 2 is a partial enlarged view of a disc and a pulse generator incorporated in the cage position detector shown in FIG. 1.

In operation, when the disc 8 is rotated in the direction of arrow A in FIG. 2, the pulse signal 14*a* from the flip-flop 14C goes high at the leading edge of the pulse signal 11*b* while the pulse signal 10*b* is high, and goes low at the trailing edge of the pulse signal 11*b* while the pulse signal 10*b* is low. Similarly, the pulse signal 14*b* from the flip-flop 14D goes high at the trailing edge of the pulse signal 10*b* while the pulse signal 11*b* is high, and goes low at the leading edge of the pulse signal 10*b* while the pulse signal 11*b* is low.

When the disc 8 is rotated in the direction of arrow B, the aforementioned operation is reversed.

Figure 7A:
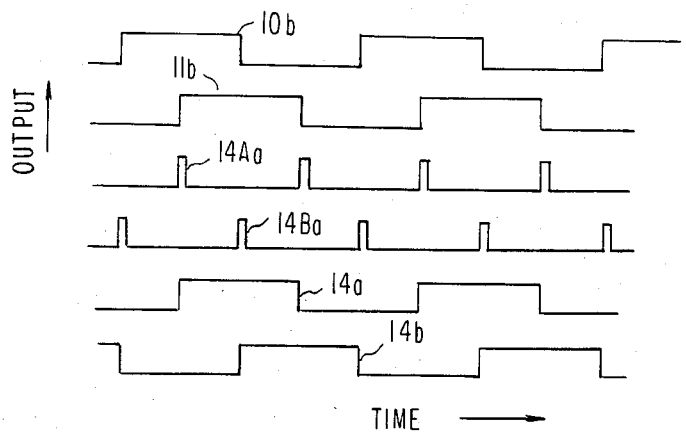
Figure 7B:
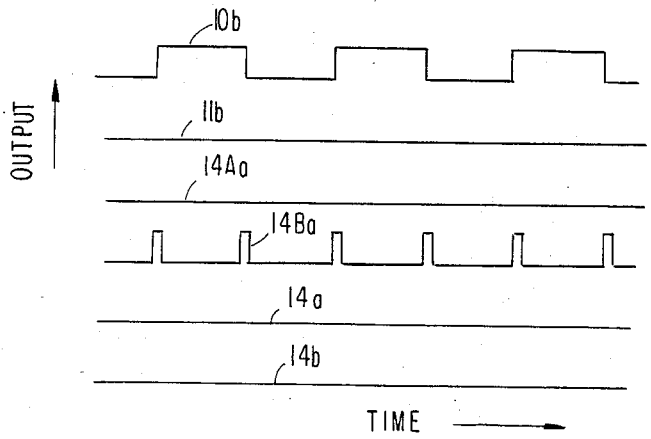

Assuming that only the pulse signal 10*b* is generated when the disc 8 is stopped as shown in FIG. 7(*b*), due to disc vibration or power supply fluctuations, the pulse edge detecting circuit 14A does not generate pulses 14A*a*. Therefore, the flip-flop 14C does not generate pulses 14*a* because of the constant input level at its terminal T, and the flip-flop 14D also does not generate pulses 14*b* because of the constant input level at its terminal D. Accordingly, the transit distance detecting circuit 13 does not operate because no movement pulses 12*a* are outputted from the pulse composing circuit 12, whereby the malfunction potential of the prior art is eliminated.

Although in FIG. 7(*b*) both of the pulses 14*a* and 14*b* are low, they may also be high depending upon the position in which the disc 8 is stopped.

Figure 8A:
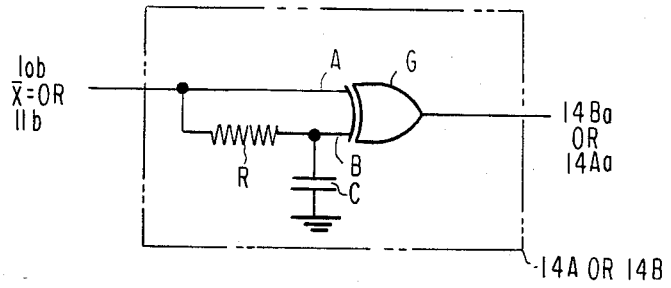
Figure 8B:
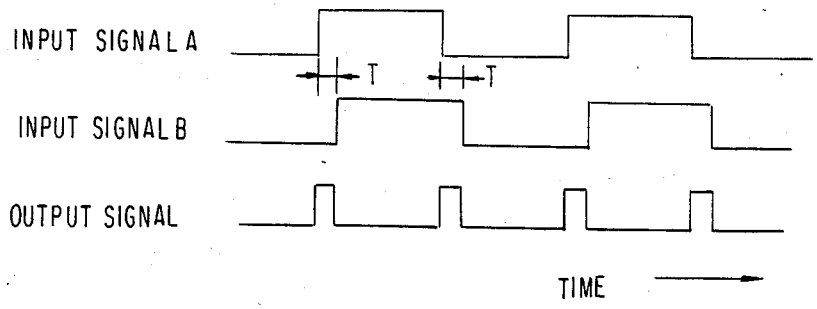

FIG. 8(*a*) shows one embodiment of the pulse edge detecting circuits 14A and 14B, each of which comprises an exclusive OR gate G, a resistor R and a grounded capacitor C. As is apparent from FIG. 8(*b*), the resistor R and capacitor C determine a delay time T between one input signal B to the exclusive OR gate G and another, direct input signal A. Consequently, the output signal from the exclusive OR gate G becomes high only when the input signals A and B have different levels.

As will be readily apparent to those skilled in the art, various alternative possibilities or modes of the invention are easily envisioned within the scope thereof.

What is claimed is:

1. In an elevator travel detecting apparatus, including a pulse generator (9) for generating a first pulse signal (10*b*) and a second pulse signal (11*b*) differing from each other in phase for each unit distance movement of an elevator cage (4), a pulse composing circuit (12) for receiving the first and second pulse signals and generating a movement pulse signal in accordance with the phase difference between said first and second pulse signals, and a transit distance detecting circuit (13) for counting the number of said movement pulses from the pulse composing circuit to detect the transit distance of the elevator cage, the improvement characterized by: means for preventing the erroneous generation and counting of movement pulses due to the false generation of only one of the pulse signals caused by vibrations or the like when the elevator cage is stopped, said means comprising error preventing circuit means (14) operatively interposed and connected between the pulse generator and the pulse composing circuit, and responsive to said first and second pulse signals for simultaneously generating first and second output pulse trains only when both of said first and second pulse signals are being received, to thereby enable the generation and counting of said movement pulses, and for preventing the generation of both said first and second pulse trains when either of said first and second pulse signals is not being received.

2. An apparatus according to claim 1, wherein said error preventing circuit means has dual output lines connected to inputs of the pulse composing circuit for transmitting said first and second pulse trains thereto only when both of said first and second pulse signals are being received.

3. An apparatus according to claim 2, wherein said error preventing circuit means comprises a first control circuit (14-1) for receiving said first and second pulse signals (10*b*, 11*b*) and for disabling the generation of the first output pulse train when said second pulse signal (11*b*) is received but said first pulse signal (10*b*) is not received, and a second control circuit (14-2) for receiving said first and second pulse signals and for disabling the generation of the second output pulse train when said first pulse signal is received but said second pulse signal is not received.

4. An apparatus according to claim 3, wherein said first control circuit comprises a first pulse edge detecting circuit (14A) which receives said second pulse signal and generates output pulses (14A*a*) at the leading and trailing edges of said second pulse signal, and a first flip-flop circuit (14C) which receives said output pulses from said first pulse edge detecting circuit and said first pulse signal (10*b*), and said second control circuit comprises a second pulse edge detecting circuit (14B) which receives said first pulse signal and generates output pulses (14B*a*) at the leading and trailing edges of said first pulse signal, and a second flip-flop circuit (14D) which receives said output pulses from said second pulse edge detecting circuit and said second pulse signal (11*b*).

5. An apparatus according to claim 1, wherein said pulse generator comprises a first detector (10) and an adjacent second detector (11) each cooperable with a disc (8) having a plurality of small apertures (8*a*) in its peripheral portion and rotated by linked movement to the cage, said first and second detectors generating the first and second pulse signals, respectively, by optically detecting said small apertures.

* * * * *